United States Patent [19]

Martel

[11] Patent Number: 4,768,478

[45] Date of Patent: Sep. 6, 1988

[54] CARBURETOR HAVING AN ELECTRICALLY ASSISTED CHOKE VALVE

[75] Inventor: Bernard Martel, Chatou, France

[73] Assignee: Solex, Nanterre, France

[21] Appl. No.: 95,623

[22] Filed: Sep. 14, 1987

[30] Foreign Application Priority Data

Sep. 17, 1986 [FR] France ..... 86 13002

[51] Int. Cl.[4] ..... F02M 1/10

[52] U.S. Cl. ..... 123/179 G; 123/438

[58] Field of Search ..... 123/179 G, 179 B, 179 A, 123/438

[56] References Cited

U.S. PATENT DOCUMENTS

| | | | |
|---|---|---|---|
| 1,319,388 | 10/1919 | Hadley . | |
| 2,600,368 | 6/1952 | Winkler | 123/179 A |
| 3,248,675 | 4/1966 | Furbacher | 236/101 |
| 4,003,355 | 1/1977 | Kamezaki et al. . | |
| 4,463,723 | 8/1984 | Tansuwan | 123/179 G |

FOREIGN PATENT DOCUMENTS

| | | | |
|---|---|---|---|
| 2530023 | 1/1976 | Fed. Rep. of Germany . | |
| 3028629 | 2/1982 | Fed. Rep. of Germany . | |
| 59-128958 | 7/1984 | Japan | 123/438 |

*Primary Examiner*—Andrew M. Dolinar

*Attorney, Agent, or Firm*—Stevens, Davis, Miller & Mosher

[57] ABSTRACT

A carburetor for internal combustion engines has an automatic starting device comprising a choke valve based toward opening by the air flow and toward closure by a temperature responsive bimetallic spiral when cold. A device further comprises a stop member an electrically controlled movable stop member having at least one active position in which it permits complete closure of the choke valve and a rest position in which it prevents closing movement of the choke valve beyond a predetermined position, and means arranged to bring said stop member into said active position, responsive to closure of the ignition switch and for being inhibited if after a sequence of operation of the cold engine during a period greater than a first threshold value, then rest condition of the engine for a period less than a second predetermined value.

7 Claims, 2 Drawing Sheets

CARBURETOR HAVING AN ELECTRICALLY ASSISTED CHOKE VALVE

BACKGROUND OF THE INVENTION

1. Technical Field

The invention relates to carburetors for internal combustion engines, of the type provided with an automatic starting device comprising a choke valve whose gradual opening, during heating up of the engine, is controlled by an element whose temperature increases progressively as the engine heats up, such as, for example, a bimetallic spiral subjected to the temperature of the cooling water of the engine or a capsule containing a heat-expandable material.

The invention relates more particularly to carburetors which comprise successively, in an intake duct or induction passage, from downstream to upstream, an operator operable throttle member, an opening of a main fuel delivery system and a choke valve urged toward closure by the element sensitive to temperature as long as said temperature is below a limit value and toward opening by the air flow round it.

2. Prior art

Most prior art carburetors of this type further include a pneumatic element subject to the vacuum which exists in the intake duct downstream of the throttle member and arranged to give the choke, as soon as the engine is self operative, a minimum degree of opening.

In carburetors provided with such a pneumatic element, the considerable degree of vacuum which exists in the intake duct at the mouth of the main delivery system when the choke is closed, enables a rich air/fuel mixture to be obtained during the time that the engine is driven by the starter motor; the choke opens partially as soon as the engine is self running, which avoids flooding and stalling of the engine due to a fuel excess.

Existing devices of this type have a serious drawback. If the engine is started up when completely cold, for example, not having run for several hours, and then is stopped after a short time (for example, after a period of operation of from one to three minutes), it is difficult to start up the engine again immediately: Since the cooling water of the engine has not had time to heat up notably, the choke valve closes again completely as soon as the engine stops. Consequently, the engine is again supplied with a mixture having a high fuel/air ratio on a further attempt to crank it into operation. Since the engine which has just run, does not need a richness as high as that of an engine which has remained inoperative for several hours, the excess of richness makes starting up difficult.

SUMMARY OF THE INVENTION

It is an object of the invention to provide a carburetor with an improved starting device. It is a more particular aspect to facilitate restarting of the engine when cold shortly after it was stopped.

For that purpose, the invention provides a carburetor of the above-defined type comprising an electrically controlled movable stop member, having at least one active position in which it permits complete closure of the choke valve and a rest position in which it prevents closing movement of the choke valve beyond a predetermined position, and means designed to bring the stop into its active position on closure of the ignition switch and to be inhibited (in order to maintain the stop in its rest position) if the ignition switch is closed after a sequence of operation of the cold engine during a period greater than a first threshold value, and non-operation of the engine for a period less than a second predetermined threshold value.

According to another aspect of the invention, the carburetor comprises first means having at least one active position in which they permit complete closure of the choke and a rest position in which they prevent the choke from closing beyond a particular position and second means designed to place the first means in active position, at least upon closure of the igintion switch, which are inhibited to maintain the first means in rest position after a sequence consisting of operation of the cold engine for a period greater than a first threshold value, then non-operation of the engine for a period less than a second threshold value.

The first means may consist of an electrically controlled movable stop associated with computer means; they may also consist of a pneumatic capsule connected to the portion of the intake duct of the carburetor situated downstream of the throttle member, the second means being then constituted by an electrically controlled valve moved into closed position when the engine, initially cold, has operated for a period greater than the first threshold value and held in closed position for a period equal to the second threshold value if there is no restarting of the engine.

In a particular embodiment of the invention, said second means may be arranged so that the movable stop member also fulfills the function usually performed by a vacuum controlled motor. Among other advantages of this solution, the carburetor is simplified and the same stop member reacts not only to the vacuum existing in the intake duct which is the only reaction in the case of a vacuum controlled motor), but also to other operating parameters of the engine.

The actuating means of the stop member typically include an electromagnet supplied by an electronic circuit having inputs connected to detectors supplying the values of parameters representative of the condition of the engine and, if required, of the environment.

The invention will be better understood from the following description of down-draft carburetors which constitute embodiments given by way of examples. The description refers to the accompanying drawings.

DETAILED DESCRIPTION

Figure 1:
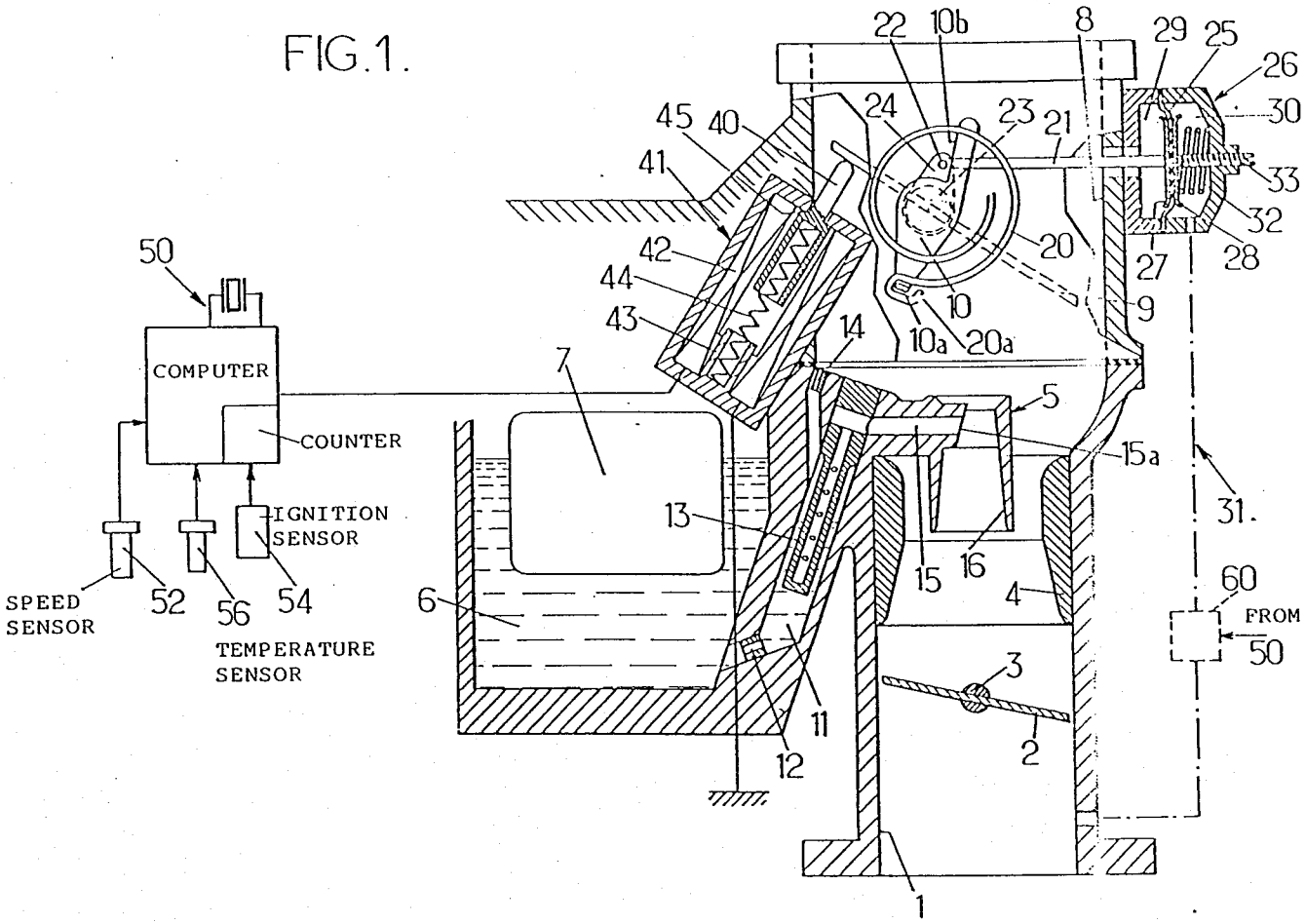
FIG. 1 is a view, in elevation and in partial cross-section through a vertical plane, of a carburetor having a starting device according to the invention, the stop member of the starting device being shown in rest position imposing a partial opening of the choke.
Figure 2:
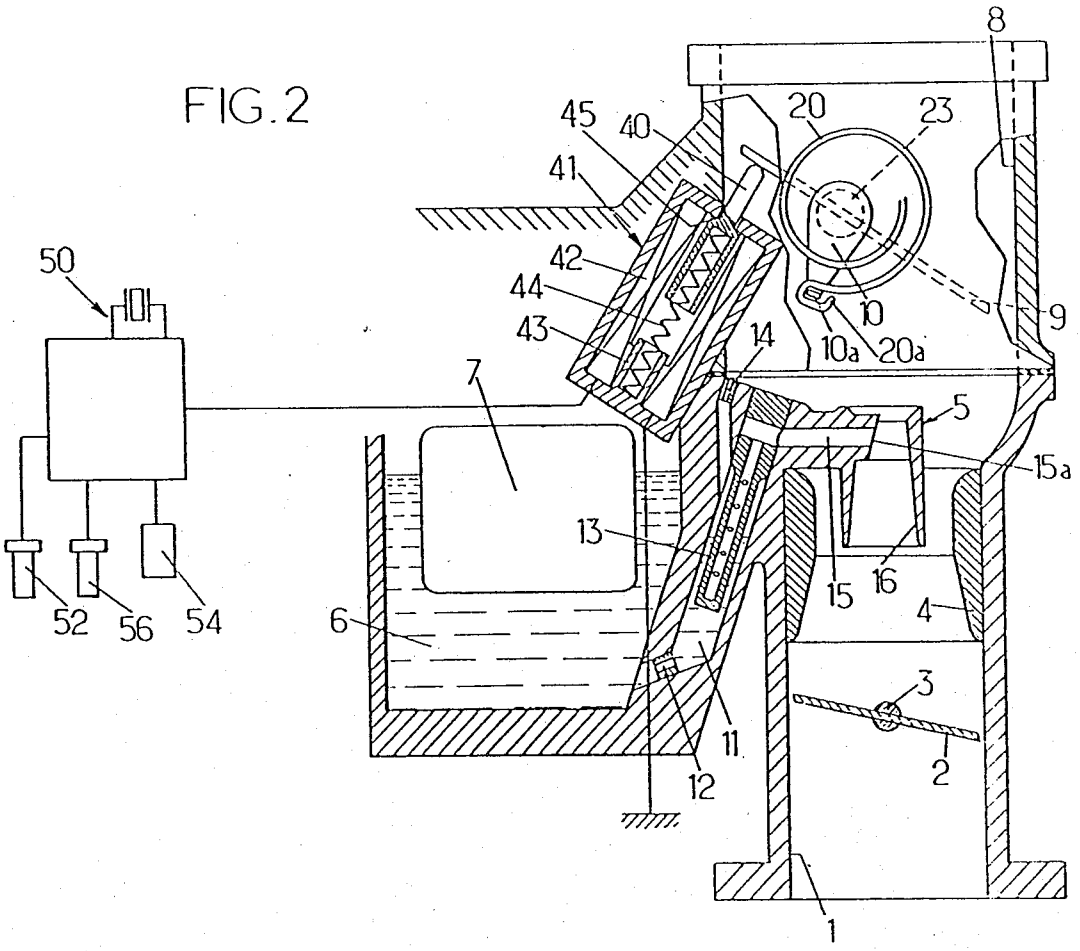
FIG. 2 similar to FIG. 1, shows a carburetor devoid of a pneumatic element for the partial opening of the choke, the stop member further fulfilling the role of the pneumatic element of a conventional carburetor.

In the two embodiments shown in FIGS. 1 and 2, where corresponding members are denoted by the same reference numbers, the carburetor comprises a body consisting of several assembled parts, defining an intake duct 1. There is to be seen, downstream to upstream, in the intake duct 1:

a throttle member 2, constituted by a butterfly valve mounted on an axle 3 and actuatable by the user, a venturi 4 at the throat of which a main jet system for an emulsified air/fuel mixture opens, which system is supplied by a float chamber 6 containing a float 7 which controls in-flow (not shown) of the fuel into the chamber, an excentrically mounted choke valve 9, placed in the air inlet 8 of the intake duct 1.

The throttle member 2 is associated with means (not shown), which may be conventional, for adjusting its minimum degree of opening in response to the temperature of the cooling water of the engine.

The main fuel jet system 5 comprises a well 11 supplied with fuel from the float chamber 6, and a jet 12. The fuel taken up from the well 11 through a tube 13 is mixed with emulsifying air coming from the air inlet 8 of the intake duct 1 through a calibrated orifice 14. A channel 15 receives the air-fuel mixture formed in the tube 13 and delivers it to the jet orifice 15*a* formed in a secondary venturi 16, placed at the neck of the throat venturi 4.

As shown, the choke valve 9 is excentrically mounted on an axle 23 fast to a lever 10 terminated by a folded finger 10*a*. The movable end 20*a* of a thermostatic member 20, such as a bimetallic spiral, is hooked on finger 10*a*. The spiral 20 is contained in a casing (not shown) fixed to the body of the carburetor and its radially inner end is fixed to a boss of the casing; the spiral 20 may be brought to a temperature representing that of the engine by conventional heating means, for example by a flow of engine cooling water. It is arranged to allow the choke valve to close when cold and to drive the valve gradually in the opening direction when its temperature increases.

In the carburetor shown in FIG. 1, the lever 10 has a unidirectional abutting connection with a rod 21. For this purpose, the lever 10 has a flat surface 10*b* for receiving the 90° folded end 22 of the rod 21. The end 22 is held at a constant distance from the axle 23 of the choke valve 9 by a lever 24 rotatably mounted on the axle 23.

The other end of the rod 21 is coupled to the diaphragm 25 of a pneumatic motor 26. The diaphragm 25 is clamped between two cups 27 and 28 and divides the casing of the capsule 26 into two compartments 29 and 30. The compartment 29 is connected to the air intake 8 of the intake duct and the compartment 30 is connected to that portion of the intake duct 1 which is situated downstream of the butterfly valve 2 via a duct 31. A spring 32 placed in the casing of the motor biases the rod in the direction of closure of the choke valve 9 and opposes the force created by the pressure differential across diaphragm 25. The degree of partial opening of the choke valve 9 upon movement of the diaphragm due to the vacuum existing in the duct 1 downstream of the butterfly valve 2 may be adjusted with a stop screw 33 for rod 21.

According to an aspect of the invention, the carburetor further comprises a movable member stop 40 for forcing the choke valve 9 into a position of partial opening. As shown, the stop member 40 is constituted by the plunger of an electromagnet 41. The electromagnet 41 has a winding 42 and a fixed central core 43. When the winding 42 is de-energized, a spring 44 brings the stop to a rest position where a shoulder of the plunger 40 bears on a seat 45 on the housing of the electromagnet 41. The stop member then prevents the choke 9 from closing beyond a predetermined position. In FIG. 1, the stop has been shown in the closure path of the choke valve, for clarity. In fact, the stop member is placed in the path of a lever fast to the choke 9 and its axle 23.

When an electric current flows in the winding 42, the plunger 40 is drawn into an active position against the core 43, and releases the choke valve 9 which can take up a fully closed position.

Electric current is supplied to the electromagnet 41 from a source (not shown) and is controlled by a circuit 50 including computer means. The latter energizes or de-energizes the electromagnet in response to the value of parameters representing the condition of the engine and provided by detectors. The latter may particularly deliver signals indicative of:

the speed n of the engine (detector 52)

closure of the ignition switch (detector 54)

the temperature of the cooling water (detector 56).

The computer means comprises a clock. It will often be incorporated in a computer controlling delivery of an air/fuel mixture to the engine under all engine operating conditions.

The computer means is wired or programmed so as to energize the winding 42 of the electromagnet 41 upon closing of the ignition switch when the engine is cold, except if the following conditions are simultaneously fulfilled:

the engine is cold and was previously operated for a time interval greater than a first predetermined value t0, the time interval which has elapsed since the engine was stopped is less than another predetermined value t1.

Here a logic AND function is involved.

To detect operation of the engine during a period greater than t0, the computer member may include a counter storing pulses supplied by the clock from the moment when the detector 52 first indicates that the engine runs at a speed greater than that at which the starter motor can drive it until the moment the engine is stopped (which moment may be detected either by the return of the speed to zero, or by the cut-off of ignition, sensed by the detector 54). The counter has a predetermined capacity and delivers an overflow signal /t0 if t0 is exceeded.

The second condition may be detected by providing a counter in the computer means 50 which counts up at the rate of the clock from the moment the engine is at rest and whose capacity corresponds to the duration t1, so that the overflow signal /t1 of the counter indicates that the period t1 has been exceeded.

A further condition to be fulfilled for energization is advantageously the closure of the ignition switch, indicated by the detector 54, so as not to consume current without need when the engine is at rest.

The temperature detector can be dispensed with; when the engine is at its normal operating temperature, the movable stop 40 is at rest and is redundant with the bimetallic spiral 20. The fact that it is withdrawn into active position is without drawback for the operation. However, it is advantageous only to use this movable stop when necessary, that is to say when the temperature of the engine is less than a particular value and hence to cut off the supply of the electromagnet as soon as the engine heats up.

A possible sequence of operation of the starting device which has just been described is as follows.

When the contact is closed while the engine is at a temperature $\theta$ sensed by the detector 56, which is less than a reference value, the electromagnet is energized, unless previously:

the engine ran at a speed at least equal to the idling speed for a time greater than a value t0, then has not operated for a time period less than t1 (t1 possibly being constant, for example, of one hour).

If the two conditions are not met, the movable stop 40 is retracted and permits complete closure of the choke valve 9.

As soon as the engine is started and runs by itself, the vacuum in the intake manifold, acting through the duct 31, partly opens the valve 9 and reduces the fuel/air ratio to permit correct operation of the engine.

The computer means 50 may be arranged to de-energize the electromagnet 41 as soon as the cooling temperature $\theta$ has reached a reference value for which the bimetallic spiral has already partly opened the choke valve, or as soon as the engine is self-operating at a speed at least equal to the idling speed. The movable stop then come back to its rest position shown in FIG. 1.

If, on the other hand, the cold engine has remained stopped after it operated for a short time, for example one to three minutes, the temperature 8 has not increased significantly and the bimetallic spiral does not exert a force sufficient for partly opening the choke. In this case, on a subsequent operation of the starter motor, the computer means 50 does not energize electromagnet 41. The movable stop 40 remains in the position shown in FIG. 1, prevents the choke valve 9 from closing completely and avoids stalling of the engine due to an excess richness.

In a modified embodiment of the invention, the stop plunger 40 and the parts associated with it are omitted. On the other hand an electrically controlled valve 60, indicated in dashes in FIG. 1, is placed in the duct 31 and is controlled by the circuit 50. If it is assumed that the valve 60 is closed when energized and opened at rest, the current 50 will provide an electric current to the value 60 to close it when it detects that the following conditions are met:

the engine was started while cold, that is to say while its temperature was less than a predetermined value, it has operated for a period greater than a first threshold value.

The circuit 50 will then include a timer for providing a time delay equal to the second abovementioned threshold value. The circuit may obviously be completed with means which inhibit energization of the valve 60 as soon as the temperature of the engine has exceeded a predetermined value, in order not to unnecessarily energize the electrovalve after a futher restart of the engine.

The operation of this embodiment will be apparent immediately; when the engine in cold condition is started while it has not operated for a long time, the pneumatic motor 26 opens the choke valve 9 slightly as soon as starting is effective.

As soon as ignition is cut off after the engine ran for a period greater than the first threshold value, the circuit 50 energizes the electrically operated vale 60 so as to retain the vacuum existing in the chamber 30 of the motor 26 and to prevent the choke valve 9 from closing completely.

In the modified embodiment of the invention shown in FIG. 2, the carburetor does not include a pneumatic motor for partially opening choke valve 9. On the other hand, the computer means 50 is programmed or wired so as to move the stop member 40 to its position as soon as the engine speed, indicated by the detector 52, is such that the engine is self operating. In practice, as soon as the spped of a passenger vehicle engine reaches 600 r.p.m., the engine is self-operating. This solution has the advantage of simplicity.

The invention is particularly suitable for use in so-called "electronic" carburetors comprising a microprocessor which can easily fulfill the additional function of functions necessary for the invention if some instructions are added to the program or some electronic components are added along with a movable stop, for example, in a carburetor as described in French Pat. No. 2,568,631.

I claim:

1. Carburetor for internal combustion engine having a body defining an intake duct and an automatic starting device comprising:

a choke valve located in said duct and arranged to be biased toward opening by an air flow in said intake duct, means responsive to the temperature of an engine fed by the carburetor for biasing said choke valve toward closure as long as said temperature is lower than a predetermined limit value, an electrically controlled movable stop member having at least an active position in which it permits complete closure of the choke valve and a rest position in which it prevents closing movement of the choke valve beyond a predetermined position, and means arranged to bring said stop member into said active position, responsive to closure of an ignition switch and to be inhibited responsive to a sequence of (a) operation of the cold engine during a period greater than a first threshold value, (b) then rest condition of the engine for a period less than a second predetermined value.

2. Carburetor according to claim 1, wherein said means includes computer means operatively associated with a speed sensor and an ignition switch closure indicative sensor to receive input signals therefrom.

3. Carburetor according to claim 2, wherein said computer means includes a clock and counter means for measuring the duration of self-operation of said engine and the time duration after end of operation of the engine.

4. Carburetor according to claim 1, wherein said carburetor is devoid of choke valve crack open vacuum responsive motor and said means are arranged for bringing back said stop member to said rest position as soon as the engine speed exceeds a predetermined value.

5. Carburetor for internal combustion engine having a body defining an intake duct and an automatic starting device comprising:

a choke valve located in said duct and arranged to be biased toward opening by an air flow in said intake duct, means responsive to the temperature of an engine fed by the carburetor for biasing said choke valve toward closure as long as said temperature is lower than a predetermined limit value, an electrically controlled movable stop member having at least one active position in which it permits complete closure of the choke valve and a rest position in which it prevents closing movement of the choke valve beyond a predetermined position, first means having at least an active position allowing complete closure of the choke valve and a rest position in which they prevent closing of the choke beyond a predetermined position, and second means operatively associated with the first means to maintain said first means in active position and arranged to be inhibited and to leave said first means in said rest position after a sequence including operation of the engine from cold for a period greater than a first predetermined threshold value, then rest condition of the engine for a period less than a second predetermined threshold value.

6. Carburetor according to claim 5, wherein said first means comprises an electrically controlled movable stop associated with computer means.

7. Carburetor according to claim 5, wherein said first means comprises a pneumatic motor connected by a line to a portion of the intake duct situated downsteam of an operation operated throttle member and said second means comprises an electrically controlled valve located in said line.

* * * * *